US007291074B2

(12) United States Patent
Kouno et al.

(10) Patent No.: US 7,291,074 B2
(45) **Date of Patent: *Nov. 6, 2007**

(54) GOLF CLUB HEAD

(75) Inventors: Masaru Kouno, Kobe (JP); Masayuki Kato, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/394,092

(22) Filed: Mar. 31, 2006

(65) Prior Publication Data

US 2006/0172820 A1 Aug. 3, 2006

Related U.S. Application Data

(62) Division of application No. 10/657,187, filed on Sep. 9, 2003, now Pat. No. 7,077,762.

(30) Foreign Application Priority Data

Sep. 10, 2002 (JP) ..... 2002-264461

(51) Int. Cl.
*A63B 53/04* (2006.01)

(52) U.S. Cl. ..... 473/314; 473/345; 473/349

(58) Field of Classification Search ..... 473/314, 473/316, 345–346, 349
See application file for complete search history.

(56) References Cited

U.S. PATENT DOCUMENTS

| | | | | |
|---|---|---|---|---|
| 5,094,383 | A * | 3/1992 | Anderson et al. | 228/176 |
| 5,348,777 | A | 9/1994 | Oonuki et al. | |
| 5,851,160 | A | 12/1998 | Rugge et al. | |
| 5,935,020 | A | 8/1999 | Stites et al. | |
| 6,425,832 | B2 | 7/2002 | Cackett et al. | |
| 6,695,712 | B1 | 2/2004 | Iwata et al. | |
| 6,716,114 | B2 | 4/2004 | Nishio | |
| 6,926,616 | B1 * | 8/2005 | Kusumoto et al. | 473/305 |

* cited by examiner

*Primary Examiner*—Stephen Blau
(74) *Attorney, Agent, or Firm*—Birch, Stewart, Kolasch & Birch

(57) ABSTRACT

A golf club head which has a head volume V of not less than 300 cc, and a gravity point distance C (mm) satisfying the following condition: $C \leqq 0.12 \times V - 8$, and optionally, the ratio (M/V) of the moment of inertia M (g·sq.cm) of the club head around a vertical axis passing through the gravity point of the club head to the head volume V (cc) is se in a range of from 9.0 to 11.0, and a sweet spot height is set in a range of from 25 to 40 mm.

9 Claims, 5 Drawing Sheets

FIG.6(a) Difference from target (m)
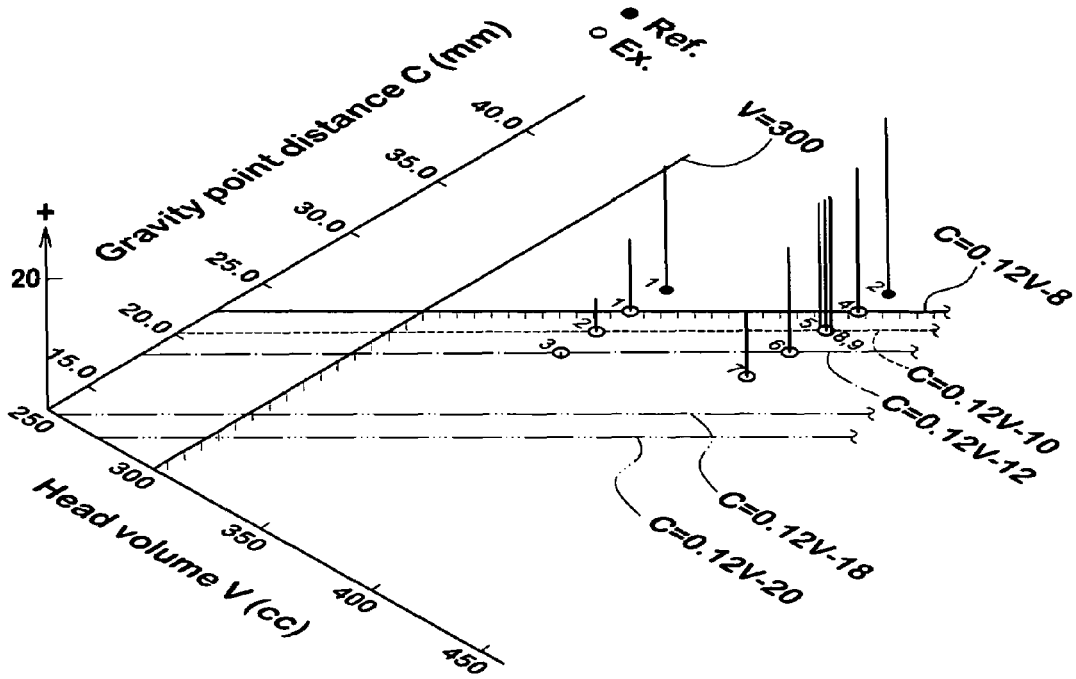
FIG.6(b) Maximum variation (m)
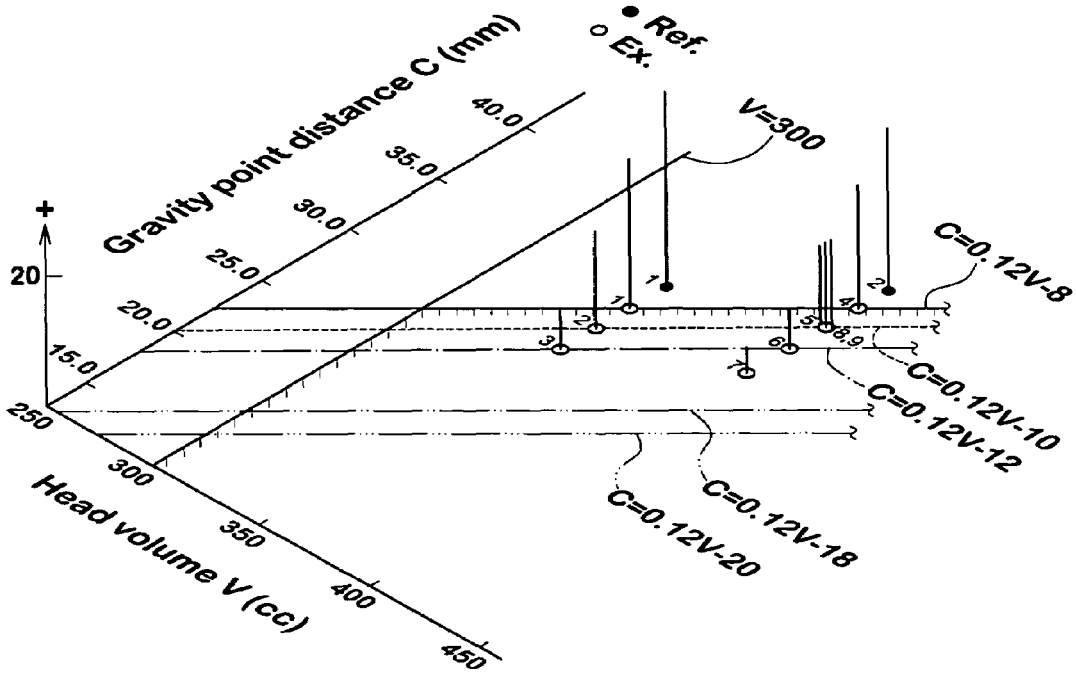

GOLF CLUB HEAD

This application is a Divisional of application Ser. No. 10/657,187, filed on Sep. 9, 2003 now U.S. Pat. No. 7,077,762, the entire contents of which are hereby incorporated by reference and for which priority is claimed under 35 U.S.C. § 120.

BACKGROUND OF THE INVENTION

The present invention relates to a golf club head, more particularly to a structure of a large-sized wood-type golf club head being capable of improving the directions of ball flights.

In recent years, wood-type golf clubs such as driver, fairway wood and the like having head volume of over 300 cc are widely used.

In general, as the head size is increased, the moment of inertia of the club head around its gravity point becomes increased. The increase in such moment may prevent twisting of the club head when impacted off-center and accordingly the directional stability of ball flights may be improved. Thus, generally considered, such aspect is desirable.

On the other hand, the increased head size may increase the gravity point distance from the club shaft center line, and the increased gravity point distance increases the moment of inertia around the club shaft. As a result, as shown in FIG. 7(*a*), the rebound of the club head at impact after downswing becomes insufficient which results in open face. This is especially true in case of a long club shaft. As a result, average golfers are liable to have a slice tendency when using such a large-sized wood-type golf club.

SUMMARY OF THE INVENTION

It is therefore, an object of the present invention to provide a golf club head, in which, by specifically defining the gravity point distance in relation to the head volume, the moments of inertia are optimized to improve the rebound of the club head and the directions of ball fights are improved.

According to the present invention, a golf club head whose head volume V is not less than 300 cc has a gravity point distance C (mm) satisfying the following condition $$C \leqq 0.12 \times V - 8 \quad (1)$$

Therefore, the rebound of the club head after downswing becomes proper as shown in FIG. 7(*b*), and an open face shot as shown in FIG. 7(*a*) can be avoided.

BRIEF DESCRIPTION OF THE DRAWINGS

FIG. 6(*a*) and FIG. 6(*b*) are bar graphs showing results of comparison tests.

FIG. 7(*b*) is a diagram showing a proper rebound of a club head and a desirable squared face.

DESCRIPTION OF THE PREFERRED EMBODIMENT

Figure 1:
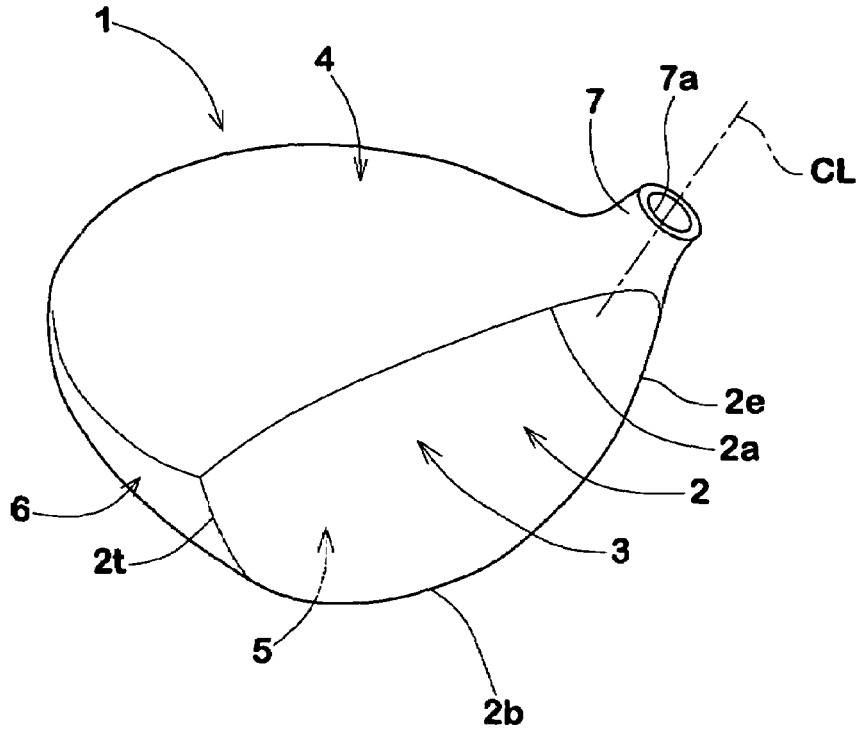
FIG. 1 is a perspective view of a wood-type golf club head according to the present invention.

An embodiment of the present invention will now be described in detail in conjunction with the accompanying drawings.

In the drawings, golf club head 1 according to the present invention is a metal wood-type hollow golf club head (number 1 wood), which comprises a face portion 3 whose front face defines a club face 2 for hitting a ball, a crown portion 4 intersecting the club face 2 at the upper edge 2*a* thereof, a sole portion 5 intersecting the club face 2 at the lower edge 2*b* thereof, a side portion 6 between the crown portion 4 and sole portion 5 which extends from a toe-side edge 2*t* to a heel-side edge 2*e* of the club face 2 through the back face of the club head, and a neck portion 7 to be attached to an end of a club shaft (not shown).

In this embodiment, the club head 1 is made up of a face plate forming the face portion 3 and an open-front hollow main body forming the remaining part of the head, namely, the crown portion 4, sole portion 5, side portion 6 and neck portion 7.

As the materials of the club head, various metal materials such as titanium alloys, pure titanium, aluminum alloys, stainless steel and the like can be used. Aside from metal materials, fiber-reinforced plastics may be used. In this embodiment, $\alpha+\beta$ type titanium alloys whose specific tensile strength is high are used. More specifically, the face plate (face portion 3) is made of Ti-4.5Al-3V-2MO-2Fe, and the main body is made of Ti-6Al-4V. The face plate is formed by press molding, giving a bulge and roll to the club face 2. The main body is formed by lost wax precision casting. Thus, the crown portion 4, sole portion 5, side portion 6 and neck portion 7 are formed integrally. The face plate is welded to the front of the main body so as to cover the front opening of the main body. Incidentally, to make the club head, various methods may be used aside from the press molding and lost wax precision casting, depending on the material and region of the head.

Figure 5:
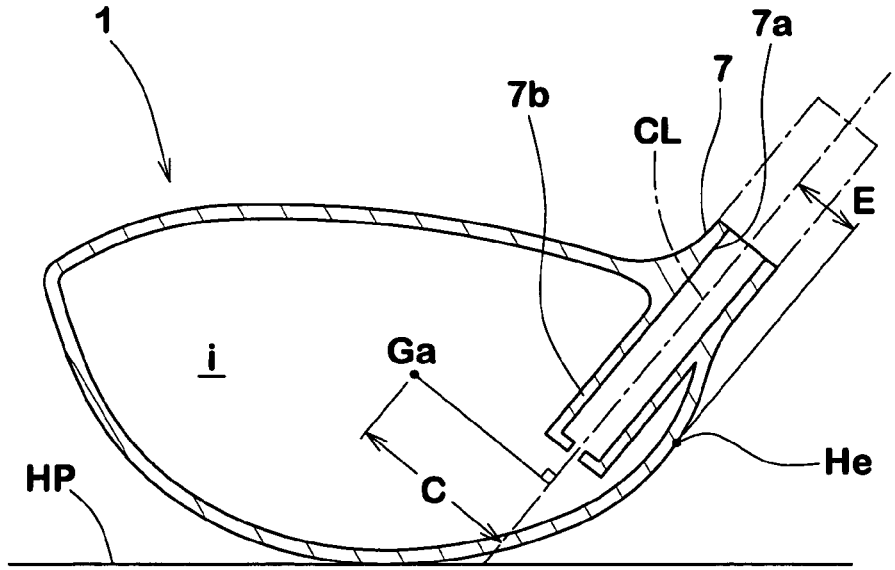
FIG. 5 is a cross sectional view of the club head taken along vertical plane VP1.

In this embodiment, the hollow (i) of the club head 1 is void as shown in FIG. 5, but it may be filled with, for example, a foamed material or the like for the purpose of, for example, controlling ball hitting sound, adjusting the mass distribution and the like.

The above-mentioned neck portion 7 is provided at the top end with an opening of a shaft inserting hole 7*a*. A tubular part 7*b* through which the shaft inserting hole 7*a* penetrates is extended into the hollow (i), keeping away from the inner surface of the club head as shown in FIG. 5. In this example, the tubular part 7*b* ends within the hollow. Thus, the hosel is a blind bore type.

In order to increase the moment of inertia around the gravity point and also for the easiness of hitting, the head volume V is set in a range of not less than 300 cc, preferably not less than 325 cc, more preferably not less than 350 cc, still more preferably not less than 375 cc, yet still more preferably not less than 400 cc. However, in view of prevention of unfavorable weight increase and durability decrease, the head volume V is limited to not more than 600 cc, preferably not more than 550 cc, more preferably not more than 500 cc, still more preferably not more than 450 cc, yet still more preferably not more than 425 cc.

Figure 2:
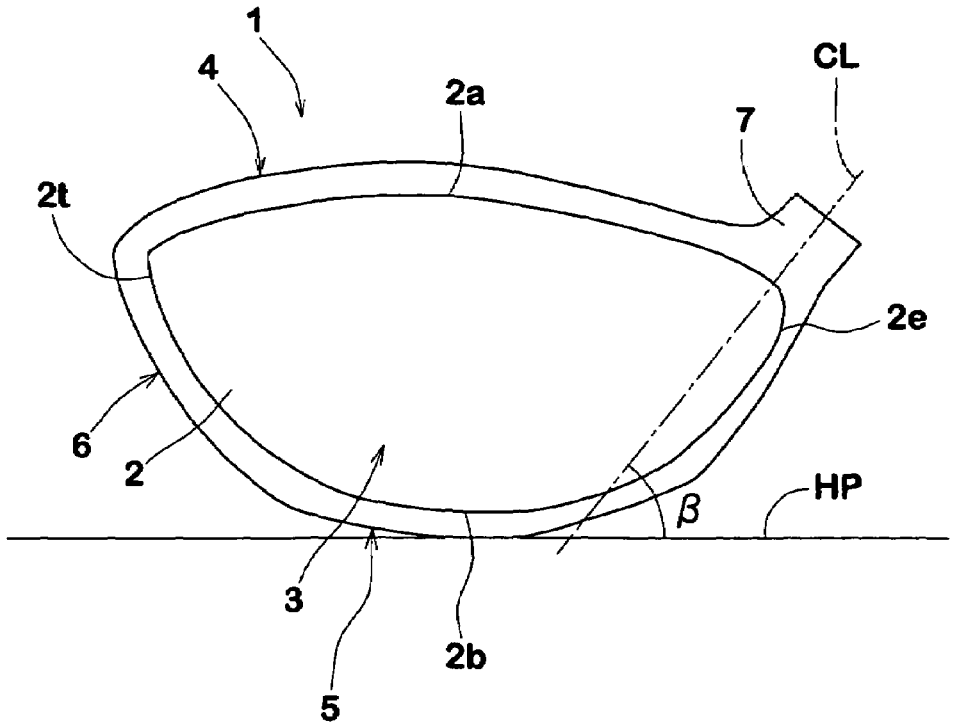
FIG. 2 is a front view thereof.
Figure 3:
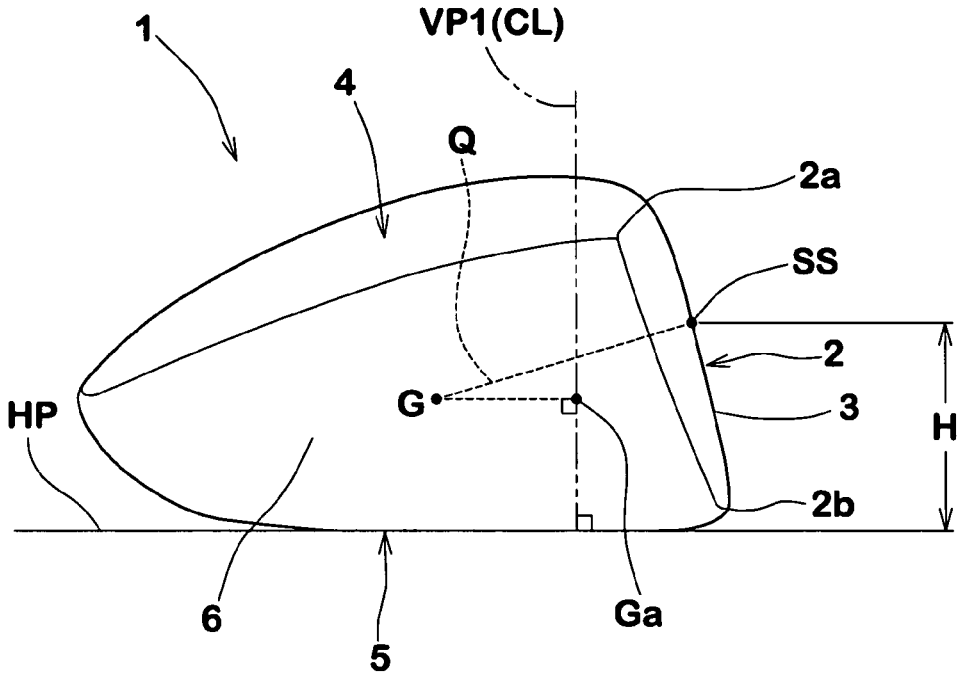
FIG. 3 is a left side view thereof.
Figure 4:
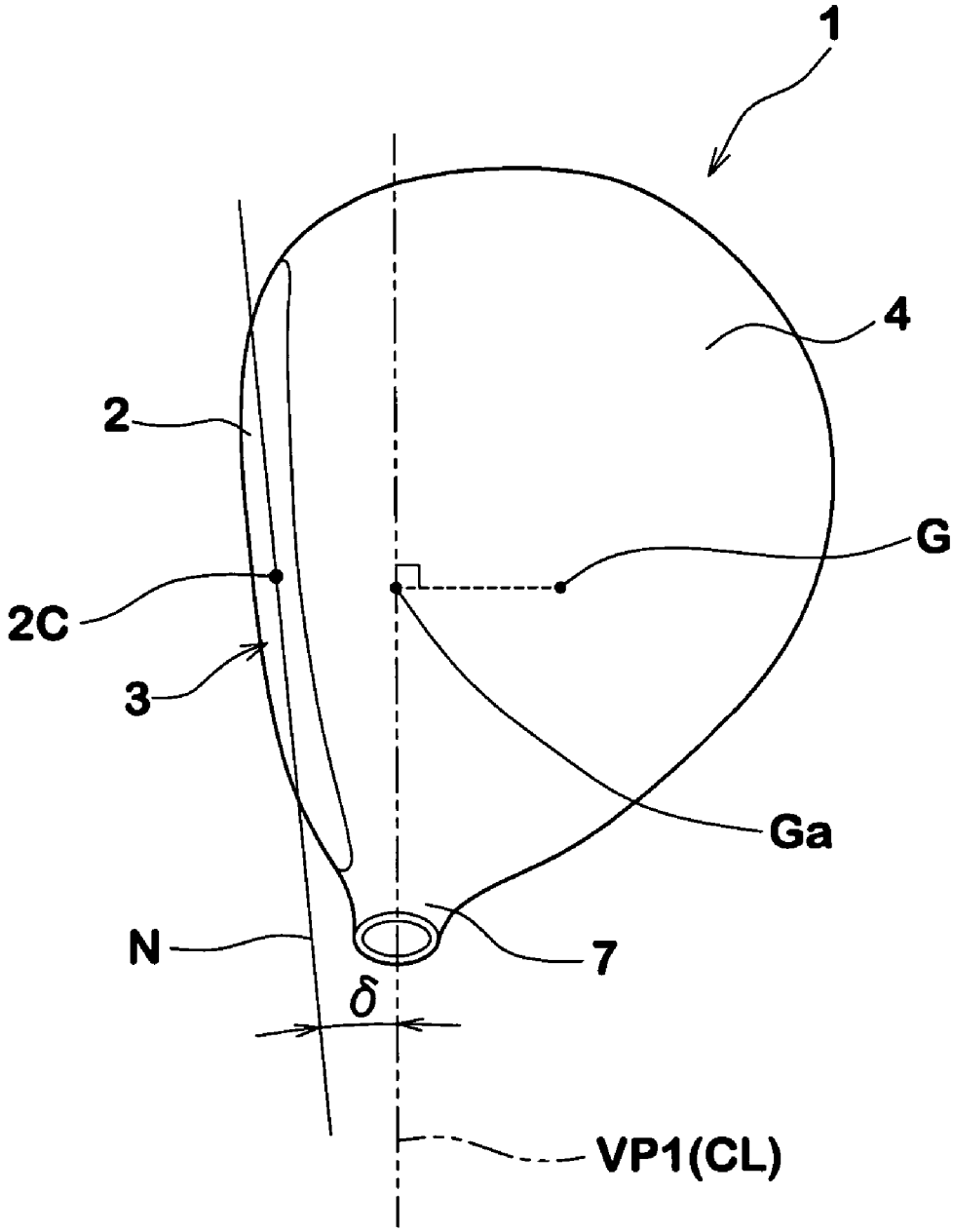
FIG. 4 is a top view thereof.
Figure 7A:
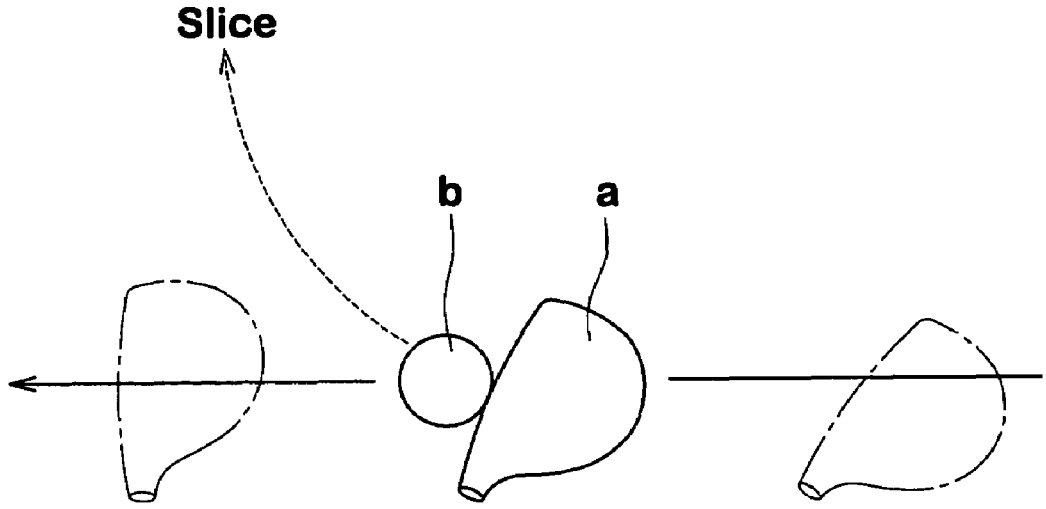
FIG. 7(*a*) is a diagram for explaining an insufficient rebound of a club head after downswing and a subsequent open face.
Figure 7B:
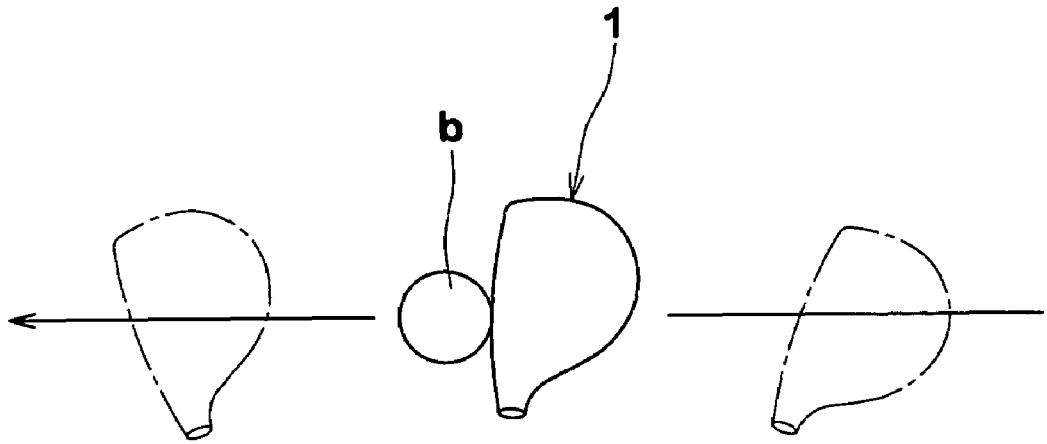

In FIGS. 2, 3, 4 and 5, the club head 1 is in its measuring position. The measuring position corresponds to that of the head where a club incorporating the head is resting in its normal address position, more specifically, a state of the club head 1 which is, as shown in FIGS. 2 and 3, set on a horizontal plane HP such that the club shaft center line CL is inclined at its lie angle β while keeping the club shaft center line CL on a vertical plane VP1, and as shown in FIG. 4, the club face 2 is inclined at its face angle 6 with respect to the vertical plane VP1 when the club face 2 is slightly curved as in this example, the angle between the vertical plane VP1 and a horizontal line N tangent to the club face 2 at the centroid 2*c* of area of the club face 2 is set to the face angle δ. Incidentally, instead of the club shaft center line CL, the center line of the shaft inserting hole 7*a* can be used when, for example, setting the club head alone in its measuring position.

By the way, the undermentioned gravity point distance C is defined as the shortest distance between the shaft center line CL and a projected gravity point Ga which is the gravity point G of the club head projected on the vertical plane VP1 perpendicularly to the vertical plane VP1 as shown in FIG. 4 and FIG. 5. The undermentioned sweet spot SS is defined as a point of intersection between the club face 2 and a straight line Q drawn from the gravity point G to the club face 2 perpendicularly to the club face 2. The undermentioned sweet spot height H is defined as the height of the sweet spot ss from the horizontal plane HP.

According to the present invention, the gravity point distance C (mm) and the head volume V (cc) satisfy the following condition (1), preferably condition (2), more preferably condition (3):

$$C \leqq 0.12 \times V - 8 \quad (1)$$

$$C \leqq 0.12 \times V - 10 \quad (2)$$

$$C \leqq 0.12 \times V - 12 \quad (3)$$

On the other hand, if the gravity point distance C is excessively short, the club face 2 is liable to become a closed face at impact. Therefore, it is preferable that the parameters C and V satisfy the following condition (4), more preferably condition (5):

$$C \geqq 0.12 \times V - 20 \quad (4)$$

$$C \geqq 0.12 \times V - 18 \quad (5)$$

If the moment of inertia of the club head is too small, the twisting of the club head when impacted off-center becomes increased to deteriorate the stability of direction of ball flight. In this embodiment, therefore, the moment of inertia M is set in a range of not less than 2800, preferably not less than 3000, more preferably not less than 3200, still more preferably not less than 3400 (g sq.cm). But, if the moment M becomes too large, the gravity point becomes high and the club head becomes heavy. Therefore, the moment of inertia M is limited to not more than 6000, preferably not more than 5500, more preferably not more than 5000, still more preferably not more than 4500 (g sq.cm). Here, the moment of inertia M is that of the club head around a vertical axis passing the gravity point G of the club head under the above-mentioned measuring position.

Furthermore, the ratio (M/V) of the moment of inertia M to the head volume V (cc) is set in a range of not less than 9, preferably not less than 9.25, more preferably not less than 9.5, still more preferably not less than 9.75, but not more than 11.0, preferably not more than 10.5, more preferably not more than 10.0. If the ratio (M/V) is more than 11.0, the gravity point is liable to become unfavorably high and the club head becomes heavy. If the ratio (M/V) is less than 9.0, it becomes difficult to prevent the club head from twisting when impacted off-center.

In case of a large-sized wood-type club head whose head volume is over 300 cc, there is a tendency for the gravity point G and sweet spot SS to increase their heights. If the sweet spot height H is increased, the ball flight becomes lower and the backspin increases. Thus, the traveling distance decreases. contrary, if the sweet spot height H is too low, the launch angle is excessively increased. Thus, the traveling distance again decreases. Therefore, the sweet spot height H is set in a range of not more than 40 mm, preferably not more than 38 mm, more preferably not more than 37 mm, still more preferably not more than 35 mm, but not less than 25 mm, preferably not less than 27 mm, more preferably not less than 30 mm.

In order to change the weight distribution of the head to achieve the above-mentioned limitations, at least one of the following methods may be employed alone or in combination: increasing the wall thickness in the sole portion 5 to lower the gravity point G; using a heavier material in the sole portion 5 to lower the gravity point G; increasing the protruding length of the neck portion 7 as shown in FIG. 5 by a chain line to shift the gravity point G towards the heel; disposing a weight towards the heel to shift the gravity point G towards the heel; and swelling a heel region of the club head to shift the gravity point G towards the heel.

As the method of shifting the gravity point G towards the heel, the swelling is preferred because the increasing of the protruding length and the disposing of a weight are difficult to increase the moment of inertia. Therefore, as shown in FIG. 5, in a cross section along the vertical plane VP1, the distance E between a heel end He and the shaft center line CL is preferably set in a range of from 8 to 16 mm, more preferably not less than 10 mm, still more preferably not less than 12 mm, but in order to avoid odd shape it is preferably limited to not more than 14 mm. Here, the heel end He is defined as the farthest point from the shaft center line CL in the direction perpendicular to the shaft center line CL towards the heel-side in the vertical plane VP1. Therefore, it becomes possible to shift the gravity point G towards the heel while increasing the head volume V and the moment of inertia M.

Comparison Tests

Wood-type golf club heads having the basic structure shown in FIGS. 1 to 5 and specifications given in Table 1 were made and each head was assembled with a 46-inche carbon shaft to make #1 wood club. Each of the club heads was composed of a main body made of Ti-6Al-4V and a face plate made of Ti-4.5Al-3V-2Mo-2Fe, which were welded together. The face bulge and face roll were both 10 inches (254 mm). The loft angle was 11 degrees. The face angle was 4 degrees. The lie angle was 56 degrees. The moment of inertia and the gravity point distance were adjusted by changing the wall thickness and the size of the neck portion. Excepting the club head Ex.9, each of the club heads was provided in the sole portion beneath the gravity point with a weight of a tungsten alloy fixed by caulking. In Ex.9, as the weight was not provided the sweet spot height became highest. In Ex.8, although the weight was provided, because of the longest protruding length of the neck portion, the sweet spot height became second largest.

Hitting test (1)

Ten golfers having handicap ranging from 20 to 30 hit golf balls ten times each with each club, and to examine the rebound of the club head at impact, the distance of the point of fall of the struck ball from the target trajectory was measured in each shot, where "+" plus sign and "−" minus sign which mean slice and hook, respectively, were added to the measurements. In each of the clubs, ten measurements obtained from each golfer were averaged, and then ten averaged values obtained from the ten golfers were averaged such averaged values are shown in Table 1 as Difference from target and also in FIG. 6(*a*) as a bar graph.

Further, from the above-mentioned ten measurements, the longest distance in slice shot and the longest distance in hook shot were found out and added as a maximum variation, and ten maximum variations obtained from the ten golfers were averaged such averaged values are shown in Table 1 as Maximum variation and also in FIG. 6(*b*) as a bar graph.

and further the decrease in the traveling distance due to off-center hitting became decreased. Ex.8 and Ex.9 had the same head volume and "C−0.12×V" value as Ex.5, but Ex.8 and Ex.9 were higher in the sweet spot height than Ex.5. Therefore, it would appear that the launch angle was decreased while the backspin was increased, and as a result the traveling distance become shorter.

Incidentally, the golf balls used in the hitting tests (1) and (2) were "MAXFLI HI-BRID" Sumitomo Rubber Industries, Ltd.

The present invention can be suitably applied to wood-type club heads whose loft angle is 7 to 12 degrees.

TABLE 1

| Club Head | Ref. 1 | Ex. 1 | Ex. 2 | Ex. 3 | Ref. 2 | Ex. 4 | Ex. 5 | Ex. 6 | Ex. 7 | Ex. 8 | Ex. 9 |
|---|---|---|---|---|---|---|---|---|---|---|---|
| Head volume V (cc) | 350 | 350 | 350 | 350 | 400 | 400 | 400 | 400 | 400 | 400 | 400 |
| Gravity point distance C (mm) | 36 | 34 | 32 | 30 | 42 | 40 | 38 | 36 | 34 | 38 | 38 |
| Value of C − 0.12 × V | −6 | −8 | −10 | −12 | −6 | −8 | −10 | −12 | −14 | −10 | −10 |
| Moment of inertia M (g · sq.cm) | 3435 | 3428 | 3443 | 3440 | 3959 | 3962 | 3955 | 3969 | 3950 | 3966 | 3970 |
| M/V | 9.814 | 9.794 | 9.837 | 9.829 | 9.898 | 9.905 | 9.888 | 9.923 | 9.875 | 9.915 | 9.925 |
| Sweet spot height H (mm) | 33.3 | 33.1 | 33 | 33.2 | 37.2 | 37 | 37.3 | 37.2 | 36.9 | 38.7 | 39.8 |
| Heel end distance E (mm) | 5 | 8 | 10 | 12 | 6 | 9 | 11 | 13 | 14 | 6 | 11 |
| Difference from target (m) | 19 | 11 | 5 | −0.8 | 27 | 22 | 19 | 16 | 10 | 20 | 21 |
| Maximum variation (m) | 30 | 23 | 15 | 6 | 25 | 19 | 12 | 6 | 4 | 13 | 14 |

Giving attention to each of the following groups—a group of Ref.1 and Ex.1, 2 and 3 having a head volume of 350 cc and a group of Ref.2 and Ex.4, 5, 6, 7, 8 and 9 having a head volume of 400 cc—, it will be clear that the difference from target decreases as the value of "C−0.12×V" becomes small (in other words, the absolute value of the negative value becomes large). Further, when compared between a group of Ex.1, 2 and 3 and a group of Ex.4, 5 and 6, it can be confirmed that the larger the head volume V, the smaller the maximum variation.

Hitting Test (2)

Further, each of the golf clubs Ex.2, 5, 8 and 9 was attached to a swing robot and hit golf balls five times at a head speed of 45 m/s to measure the traveling distance (carry+run), and the five measurements were averaged such averaged traveling distance was obtained with respect to each of three hitting positions on the club face: sweet spot SS, a position 20 mm towards the toe from the sweet spot, and a position 20 mm towards the heel from the sweet spot. The test results are shown in Table 2.

TABLE 2

| Club Head | Ex. 2 | Ex. 5 | Ex. 8 | Ex. 9 |
|---|---|---|---|---|
| Traveling distance | | | | |
| Sweet spot (m) | 243 | 246 | 236 | 225 |
| 20 mm toe-side (m) | 222 | 234 | 222 | 210 |
| 20 mm heel-side (m) | 220 | 232 | 219 | 209 |

As apparent from a comparison between Ex.2 and Ex.5 having the same "C−0.12×V" value, the traveling distance became increased in Ex.5 because of the larger head volume, However, when the target users are average golfers, the loft angle is set in a range of 10.5 to 12 degrees, more suitably 11 to 12 degrees. Aside from driver, the present invention can be applied to other wood-type club heads such as fairway wood and the like.

The invention claimed is:

1. A wood-type golf club head comprising:

an open-front hollow main body; and a face plate attached to the front of the main body, wherein the main body is formed by casting, and the face plate is formed by press molding, wherein the main body has a neck portion at the top end with an opening of a shaft inserting hole and a tubular part through which the shaft inserting hole penetrates, and the tubular part is extended into a hollow portion of the main body and terminates within the hollow portion so that an end of the shaft is kept away from an inner surface of the main body, said golf club head having a head volume V of not less than 300 cc, and a gravity point distance C (mm) satisfying the following condition:

$$(0.12\times V)-20 \leqq C \leqq (0.12\times V)-12$$

wherein in a state of the club head which is set on a horizontal plane HP such that a club shaft center line CL is inclined at its lie angle beta while keeping the club shaft center line CL on a vertical plane VP1, and the club face is inclined at its face angle delta with respect to the vertical plane VP1, the gravity point distance C is defined as the shortest distance between the shaft center line CL and a projected gravity point Ga which is the gravity point G of the club head projected on the vertical plane VP1, in a cross section of the club head along the vertical plane VP1, the shortest distance E between a heel end and the shaft center line CL is in a range of from 8 to 16 mm, wherein the heel end is defined as the farthest point from the shaft center line CL in the direction perpendicular to the shaft center line CL towards the heel of the head, the ratio (M/V) of the moment of inertia M (g sq.cm) of the club head around a vertical axis passing through the gravity point of the club head to the head volume V (cc) is in a range from 9.0 to 11.0, and a sweet spot height is in a range of from 25 to 40 mm.

2. The golf club head according to claim 1, wherein the head volume V (cc) and gravity point distance C (mm) satisfy the following condition:

$$C \geqq (0.12 \times V) - 18.$$

3. The golf club head according to claim 1, wherein the face plate is welded to the main body.

4. The golf club head according to claim 1, wherein the face plate is welded to the main body, so that the golf club head has a closed hollow.

5. The golf club head according to claim 1, wherein the main body and face plate are each made of a titanium alloy.

6. The golf club head according to claim 1, wherein the main body is made of a titanium alloy, and the face plate is made of a titanium alloy different from the main body.

7. The golf club head according to claim 1, wherein the face plate is made of a titanium alloy.

8. The golf club head according to claim 1, wherein the materials for making the club head are materials selected from a group consisting of titanium alloys, pure titanium, aluminum alloys, stainless steel and fiber-reinforced plastics.

9. A wood-type golf club bead comprising:

an open-front hollow main body part; and a face plate part attached to the front of the main body part, wherein the face plate part is formed by press molding of a titanium alloy, and the main body part is formed by casting of a metal material, wherein the main body has a neck portion at the top end with an opening of a shaft inserting hole and a tubular part through which the shaft inserting hole penetrates, and the tubular part is extended into a hollow portion of the main body and terminates within the hollow portion so that an end of the shaft is kept away from an inner surface of the main body, said golf club head having a head volume V of not less than 300 cc, and a gravity point distance C (mm) satisfying the following condition:

$$(0.12 \times V) - 20 \leqq C \leqq (0.12 \times V) - 12$$

wherein in a state of the club head which is set on a horizontal plane HP such that a club shaft center line CL is inclined at its lie angle beta while keeping the club shaft center line CL on a vertical plane VP1, and the club face is inclined at its face angle delta with respect to the vertical plane VP1, the gravity point distance C is defined as the shortest distance between the shaft center line CL and a projected gravity point Ga which is the gravity point G of the club head projected on the vertical plane VP1, in a cross section of the club head along the vertical plane VP1, the shortest distance E between a heel end and the shaft center line CL is in a range of from 8 to 16 mm, wherein the heel end is defined as the farthest point from the shaft center line CL in the direction perpendicular to the shaft center line CL towards the heel of the head, the ratio (M/V) of the moment of inertia M (g sq.cm) of thc club head around a vertical axis passing through the gravity point of the club head to the head volume V (cc) is in a range from 9.0 to 11.0, and a sweet spot height is in a range of from 25 to 40 mm.

* * * * *